US007353893B1

(12) United States Patent
Hall et al.

(10) Patent No.: US 7,353,893 B1
(45) Date of Patent: Apr. 8, 2008

(54) TOOL WITH A LARGE VOLUME OF A SUPERHARD MATERIAL

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/668,254

(22) Filed: Jan. 29, 2007

Related U.S. Application Data

(63) Continuation-in-part of application No. 11/553,338, filed on Oct. 26, 2006.

(51) Int. Cl.
*E21B 10/36* (2006.01)

(52) U.S. Cl. ..... 175/425; 175/434; 175/435; 299/111

(58) Field of Classification Search ..... 175/425, 175/434, 435; 299/110, 111, 113
See application file for complete search history.

(56) References Cited

U.S. PATENT DOCUMENTS

| | | | | |
|---|---|---|---|---|
| 2,004,315 | A | | 6/1935 | Fean |
| 3,746,396 | A | | 7/1973 | Radd |
| 3,807,804 | A | | 4/1974 | Kniff |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,109,737 | A | * | 8/1978 | Bovenkerk ..... 175/430 |
| 4,201,421 | A | | 5/1980 | Den Besten |
| 4,277,106 | A | | 7/1981 | Sahley |
| 4,333,902 | A | | 6/1982 | Hara |
| 4,333,986 | A | | 6/1982 | Tsuji |
| 4,412,980 | A | * | 11/1983 | Tsuji et al. ..... 423/446 |
| 4,425,315 | A | | 1/1984 | Tsuji |
| 4,484,644 | A | | 11/1984 | Cook |
| 4,489,986 | A | | 12/1984 | Dziak |
| 4,678,237 | A | | 7/1987 | Collin |
| 4,682,987 | A | | 7/1987 | Brady |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,944,559 | A | | 7/1990 | Sionnet |
| 5,011,515 | A | | 4/1991 | Frushour |
| 5,154,245 | A | | 10/1992 | Waldenstrom |
| 5,251,964 | A | | 10/1993 | Ojanen |
| 5,332,348 | A | | 7/1994 | Lemelson |
| 5,417,475 | A | | 5/1995 | Graham |
| 5,447,208 | A | | 9/1995 | Lund |

(Continued)

*Primary Examiner*—Jennifer H. Gay
*Assistant Examiner*—Brad Harcourt
(74) *Attorney, Agent, or Firm*—Tyson J. Wilde

(57) ABSTRACT

In one aspect of the invention, a tool has a wear-resistant base suitable for attachment to a driving mechanism and also a hard tip attached to an interfacial surface of the base. The tip has a first cemented metal carbide segment bonded to a superhard material at a non-planar interface. The tip has a height between 4 and 10 mm and also has a curved working surface opposite the interfacial surface. A volume of the superhard material is about 75% to 150% of a volume of the first cemented metal carbide segment.

19 Claims, 10 Drawing Sheets

U.S. PATENT DOCUMENTS

| | | | | |
|---|---|---|---|---|
| 5,535,839 | A | 7/1996 | Brady | |
| 5,542,993 | A | 8/1996 | Rabinkin | |
| 5,653,300 | A | 8/1997 | Lund | |
| 5,823,632 | A | 10/1998 | Burkett | |
| 5,845,547 | A | 12/1998 | Sollami | |
| 5,848,657 | A | 12/1998 | Flood | |
| 5,875,862 | A | 3/1999 | Jurewicz | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa | |
| 6,056,911 | A | 5/2000 | Griffin | |
| 6,113,195 | A | 9/2000 | Mercier | |
| 6,170,917 | B1 | 1/2001 | Heinrich | |
| 6,196,636 | B1 | 3/2001 | Mills | |
| 6,196,910 | B1 | 3/2001 | Johnson | |
| 6,216,805 | B1 | 4/2001 | Lays | |
| 6,220,375 | B1 * | 4/2001 | Butcher et al. | 175/428 |
| 6,270,165 | B1 | 8/2001 | Peay | |
| 6,302,225 | B1 * | 10/2001 | Yoshida et al. | 175/434 |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,499,547 | B2 | 12/2002 | Scott | |
| 6,508,318 | B1 | 1/2003 | Linden | |
| 6,517,902 | B2 | 2/2003 | Drake | |
| 6,585,326 | B2 | 7/2003 | Sollami | |
| 6,596,225 | B1 | 7/2003 | Pope | |
| 6,685,273 | B1 | 2/2004 | Sollami | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,824,225 | B2 | 11/2004 | Stiffler | |
| 6,889,890 | B2 | 5/2005 | Yamazaki | |
| 6,966,611 | B1 | 11/2005 | Sollami | |
| 6,994,404 | B1 | 2/2006 | Sollami | |
| 7,204,560 | B2 | 4/2007 | Mercier | |
| 2001/0004946 | A1 | 6/2001 | Jensen | |
| 2003/0209366 | A1 | 11/2003 | McAlvain | |
| 2004/0026983 | A1 | 2/2004 | McAlvain | |
| 2004/0065484 | A1 | 4/2004 | McAlvain | |
| 2005/0044800 | A1 | 3/2005 | Hall | |
| 2006/0237236 | A1 | 10/2006 | Sreshta | |

* cited by examiner

TOOL WITH A LARGE VOLUME OF A SUPERHARD MATERIAL

CROSS REFERENCE TO RELATED APPLICATIONS

This application is a continuation-in-part of U.S. patent application Ser. No. 11/553,338 which was filed on Oct. 26, 2006 and was entitled Superhard Insert with an Interface. U.S. patent application Ser. No. 11/553,338, which is herein incorporated by reference for all that it contains, is currently pending.

BACKGROUND OF THE INVENTION

The invention relates to an improved cutting element or insert that may be used in machinery such as crushers, picks, grinding mills, roller cone bits, rotary fixed cutter bits, earth boring bits, percussion bits or impact bits, and drag bits. More particularly, the invention relates to inserts comprised of a cemented metal carbide segment with a non-planar interface and an abrasion resistant layer of a superhard material affixed thereto using a high pressure high temperature press apparatus. Such inserts typically comprise a superhard material formed under high temperature and pressure conditions, usually in a press apparatus designed to create such conditions, cemented to a carbide segment containing a metal binder or catalyst such as cobalt. The segment is often softer than the superhard material to which it is bound. Some examples of superhard materials that high temperature high pressure (HPHT) presses may produce and sinter include cemented ceramics, diamond, polycrystalline diamond, and cubic boron nitride. A cutting element or insert is normally fabricated by placing a cemented carbide segment into a container or cartridge with a layer of diamond crystals or grains loaded into the cartridge adjacent one face of the segment. A number of such cartridges are typically loaded into a reaction cell and placed in the high pressure high temperature press apparatus. The segments and adjacent diamond crystal layers are then compressed under HPHT conditions which promotes a sintering of the diamond grains to form the polycrystalline diamond structure. As a result, the diamond grains become mutually bonded to form a diamond layer over the substrate face, which is also bonded to the substrate face.

Such inserts are often subjected to intense forces, torques, vibration, high temperatures and temperature differentials during operation. As a result, stresses within the structure may begin to form. Drill bits for example may exhibit stresses aggravated by drilling anomalies during well boring operations such as bit whirl or spalling often resulting in delamination or fracture of the abrasive layer or carbide segment thereby reducing or eliminating the cutting element's efficacy and decreasing overall drill bit wear life. The ceramic layer of an insert sometimes delaminates from the carbide segment after the sintering process and/or during percussive and abrasive use. Damage typically found in percussive and drag bits is a result of shear failures, although non-shear modes of failure are not uncommon. The interface between the ceramic layer and carbide segment is particularly susceptible to non-shear failure modes.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud.

U.S. Pat. No. 6,196,340 by Jensen, which is herein incorporated by reference for all that it contains, discloses a cutting element insert provided for use with drills used in the drilling and boring through of subterranean formations.

U.S. Pat. No. 6,258,139 by Jensen, which is herein incorporated by reference for all that it contains, discloses a cutting element, insert or compact which is provided for use with drills used in drilling and boring subterranean formation or in machining of metal, composites or wood-working.

U.S. Pat. No. 6,260,639 by Yong et al., which is herein incorporated by reference for all that it contains, discloses a cutter element for use in a drill bit, having a substrate comprising a grip portion and an extension and at least a cutting layer affixed to said substrate.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

BRIEF SUMMARY OF THE INVENTION

In one aspect of the invention, a tool has a wear-resistant base suitable for attachment to a driving mechanism and also a hard tip attached to the base at an interfacial surface. The driving mechanism may be attached to a milling drum, a drill pipe, a trenching machine, a mining machine, or combinations thereof. The tip has a first cemented metal carbide segment bonded to a superhard material at a non-planar interface. The tip has a height between 4 and 10 mm and also has a curved working surface opposite the interfacial surface. A volume of the superhard material is about 75% to 150% of a volume of the first cemented metal carbide segment.

In the preferred embodiment, the tip has a volume of 0.2 to 2.0 ml. The tip also has a rounded geometry that may be conical, semispherical, domed, or a combination thereof. A maximum thickness of the superhard material may be approximately equal to a maximum thickness of the first metal carbide segment. The superhard material may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The material may also be sintered with a catalytic element such as iron, cobalt, nickel, silicon, hydroxide, hydride, hydrate, phosphorus-oxide, phosphoric acid, carbonate, lanthanide, actinide, phosphate hydrate, hydrogen phosphate, phosphorus carbonate, alkali metals alkali earth metals, ruthenium, rhodium, palladium, chromium, manganese, tantalum or combinations thereof.

The first cemented metal carbide segment may have a diameter of 9 to 13 mm and may have a height of 2 to 6 mm. The carbide segment may also comprise a region proximate the non-planar interface that has a higher concentration of a binder than its distal region.

In some embodiments, the base has a second carbide segment that is brazed to the tip with a first braze that has a melting temperature from 800 to 970 degrees Celsius. The first braze has a melting temperature from 700 to 1200 degrees Celsius and comprises silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. The second cemented metal carbide may have a volume of 0.1 to 0.4 ml and comprises a generally frustoconical geometry. The metal carbide segments may comprise tungsten, titanium, molybdenum, niobium, cobalt, and/or combinations thereof. The first end of the second segment has a cross sectional thickness of about 6 to 20 mm and the second end of the second segment has a cross sectional thickness of 25 to 40 mm. A portion of the superhard material is 0.5 to 3 mm away from the interface between the carbide segments.

DETAILED DESCRIPTION OF THE INVENTION AND THE PREFERRED EMBODIMENT

Figure 1:
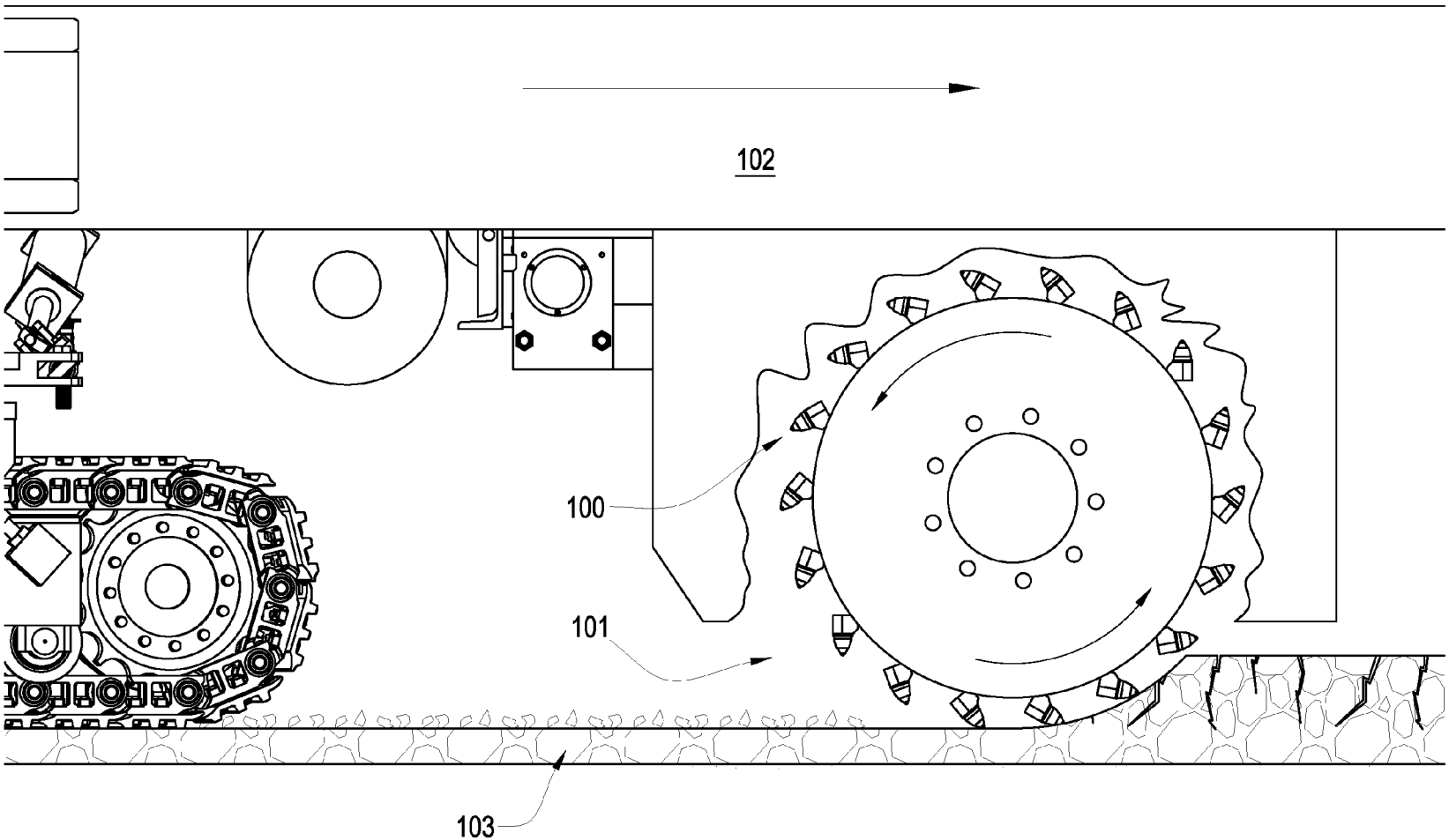
FIG. 1 is a cross-sectional diagram of an embodiment of attack tools on a rotating drum attached to a motor vehicle.

FIG. 1 is a cross-sectional diagram of an embodiment of attack tools 100 on a rotating drum 101 attached to a motor vehicle 102. The motor vehicle 102 may be a cold planer used to degrade manmade formations such as pavement 103 prior to the placement of a new layer of pavement. In other embodiments the motor vehicle may be a mining vehicle used to degrade natural formations or an excavating machine. Tools 100 may be attached to a drum 102 as shown or in other embodiments a chain may be used. As the drum or chain rotate so the tools 100 engage the formation and thereby degrade it. The formation may be hard and/or abrasive and cause substantial wear on prior art tools. The wear-resistant tool 100 of the present invention may be selected from the group consisting of drill bits, asphalt picks, mining picks, hammers, indenters, shear cutters, indexable cutters, and combinations thereof.

Figure 2:
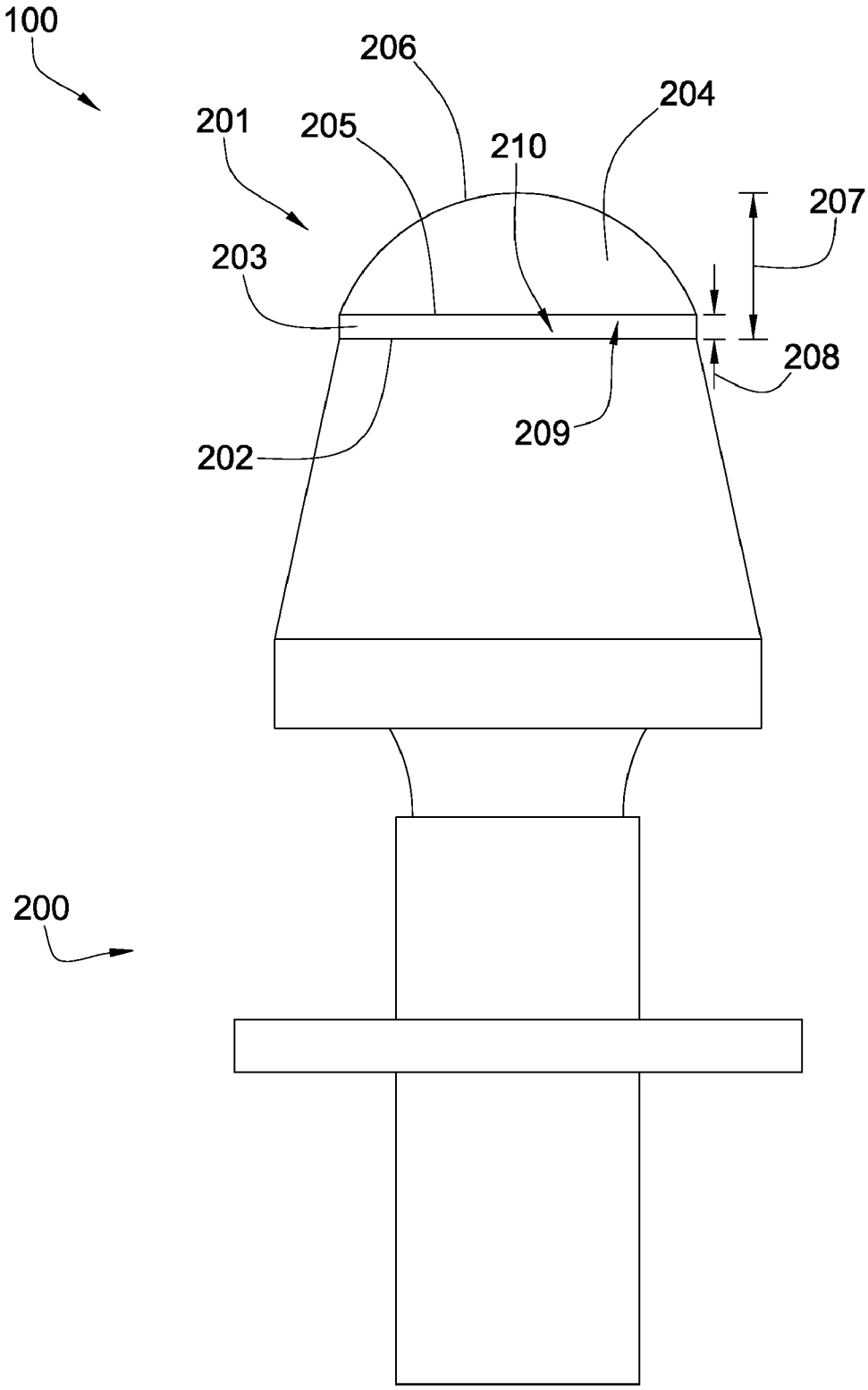
FIG. 2 is an orthogonal diagram of an embodiment of an attack tool.

FIG. 2 is an orthogonal diagram of an embodiment of an attack tool 100 comprising a base 200 suitable for attachment to a driving mechanism and a tip 201 attached to an interfacial surface 202 of the base 200. The driving mechanism may be attached to a milling drum, a drill pipe, a trenching machine, a mining machine, or combinations thereof. The tip 201 has a first cemented metal carbide segment 203 that is bonded to a superhard material 204 at a non-planar interface 205, the tip 201 having a curved working surface 206 opposite the interfacial surface 202. The curved working surface 206 may be conical, semi-spherical, domed or combinations thereof. The tip 201 may comprise a height 207 of 4 to 10 mm and a volume of 0.2 to 0.8 ml. The first cemented metal carbide segment 203 may comprise a height 208 of 2 to 6 mm. The first metal carbide segment 203 comprises a region 209 proximate the non-planar interface 205 that has a higher concentration of a binder than a distal region 210 of the first metal carbide segment 203 to improve bonding or add elasticity to the tool. The volume of the superhard material 204 may be about 75% to 150% of the volume of the first cemented metal carbide segment 203. In the some embodiments, the volume of the superhard material 204 is 95% of the volume of the first cemented metal carbide segment 203. The superhard material 204 may comprise polycrystalline diamond, vapor-deposited diamond, natural diamond, cubic boron nitride, infiltrated diamond, layered diamond, diamond impregnated carbide, diamond impregnated matrix, silicon bounded diamond, or combinations thereof. Also, the superhard material 204 may be sintered with a catalytic element comprising iron, cobalt, nickel, silicon, hydroxide, hydride, hydrate, phosphorus-oxide, phosphoric acid, carbonate, lanthanide, actinide, phosphate hydrate, hydrogen phosphate, phosphorus carbonate, alkali metals, alkali earth metals, ruthenium, rhodium, palladium, chromium, manganese, tantalum or combinations thereof.

In some embodiments, the first cemented metal carbide segment 203 may have a relatively small surface area to bind with the superhard material 204 reducing the amount of superhard material required and reducing the overall cost of the attack tool. In embodiments where high temperature and high pressure processing are required, the smaller the first metal carbide segment 203 is the cheaper it may be to produce large volumes of attack tool since more segments 203 may be placed in a high temperature high pressure apparatus at once.

Figure 3:
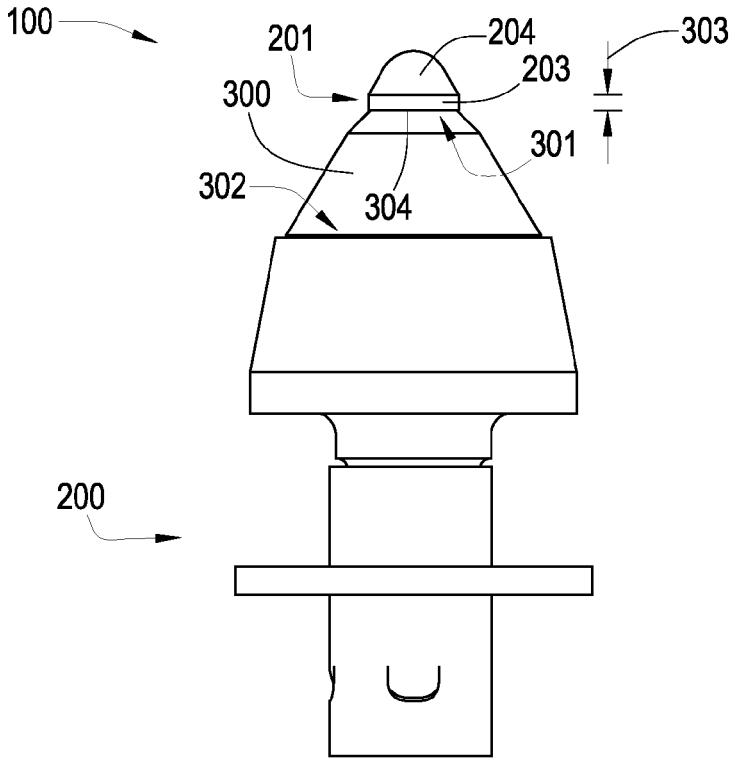
FIG. 3 is an orthogonal diagram of another embodiment of an attack tool.

FIG. 3 is an orthogonal diagram of another embodiment of an attack tool 100 with a first cemented metal carbide segment 203. In this embodiment, the braze material has a melting temperature of 800 to 970 degrees Celsius. The second metal carbide segment 300 may have a first end 301 that comprises a cross sectional thickness of about 6 to 20 mm and a second end 302 that comprises a cross sectional thickness of 25 to 40 mm. The second carbide segment 300 and the tip 201 are brazed together with a first braze material comprising a melting temperature from 700 to 1200 degrees Celsius. This first braze material may comprise silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. The first braze material may comprise 30 to 60 weight percent nickel, 30 to 62 weight percent palladium, and 3 to 15 weight percent silicon. In embodiments, the first braze material may comprise 44.5 weight percent nickel, 45.5 weight percent palladium, 5.0 weight percent silicon, and 5.0 weight percent cobalt. In other embodiments, the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the first cemented metal carbide segment 203 and the superhard material 204. In some embodiments, the second braze material may be layered for easing the stresses that may arise when bonding carbide to carbide. Such braze materials may be available from the Trimet® series provided by Lucas-Milhaupt, Inc a Handy & Harman Company located at 5656 S. Pennsylvania Ave. Cudahy, Wis. 53110, USA.

A portion of the superhard material 204 may be a distance 303 of 0.5 to 3 mm away from an interface 304 between the carbide segments 203, 300. The greater the distance 303, the less thermal damage is likely to occur during brazing. However, increasing the distance 303 may also increase the moment on the first metal carbide segment and increase stresses at the interface 304. The metal carbide segments 203, 300 may comprise tungsten, titanium, molybdenum, niobium, cobalt, and/or combinations thereof. The second metal carbide segment 300 comprises a generally frustoconical geometry and may have a volume of 1 to 10 ml. The geometry may be optimized to move cuttings away from the tool 100, distribute impact stresses, reduce wear, improve degradation rates, protect other parts of the tool 100, and/or combinations thereof.

Figure 4:
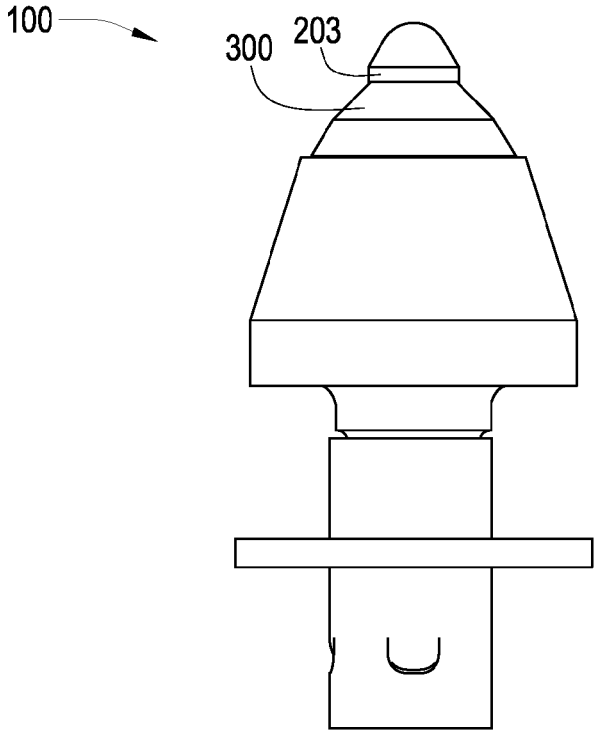
FIG. 4 is an orthogonal diagram of another embodiment of an attack tool.

FIG. 4 is an orthogonal diagram of another embodiment of an attack tool 100 with cemented metal carbide segments 203, 300. The second metal carbide segment 300 may have a smaller volume than that shown in FIG. 3, helping to reduce the weight of the tool 100 which may require less horsepower to move or it may help to reduce the cost of the attack tool 100.

Figure 5:
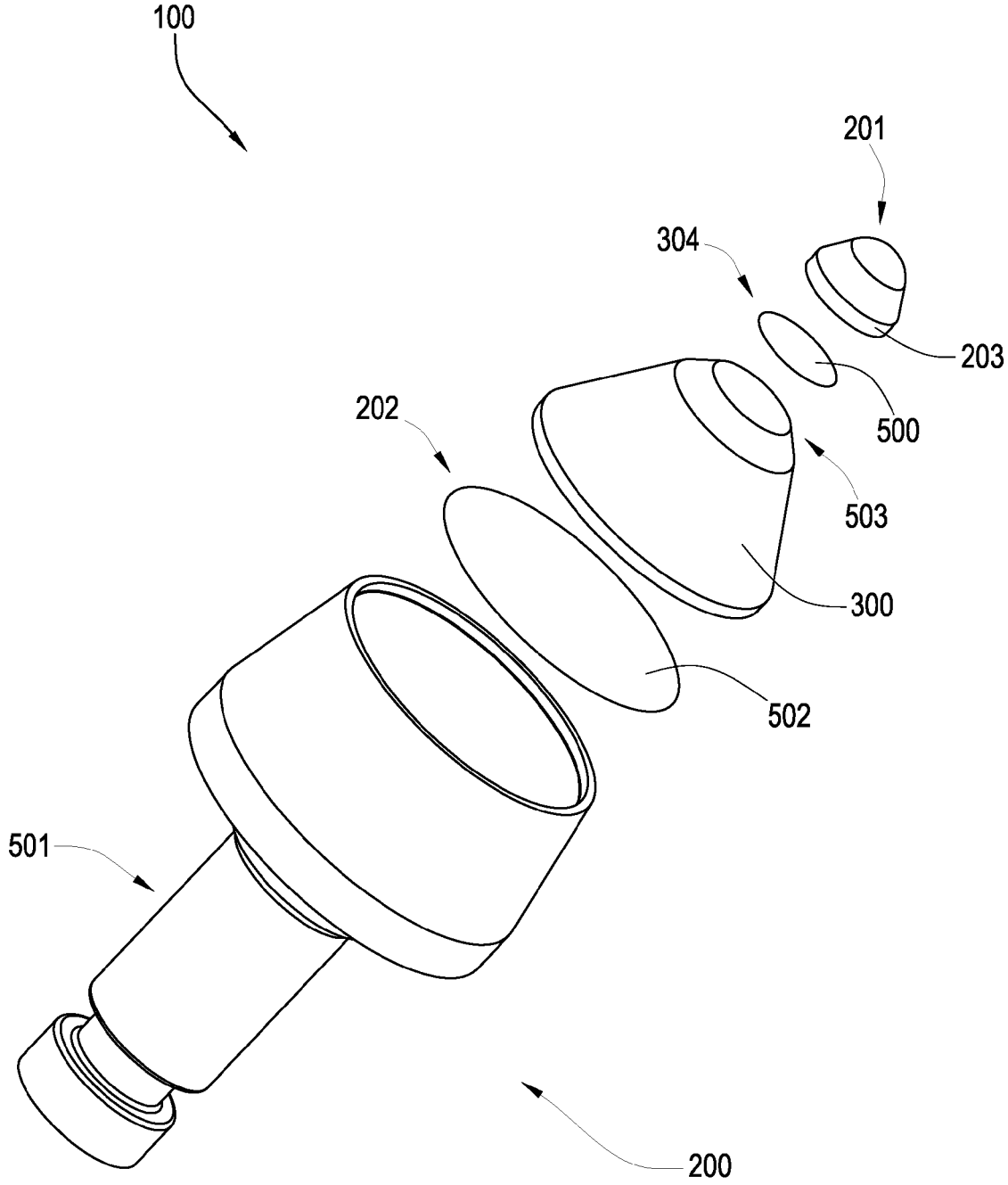
FIG. 5 is an exploded perspective diagram of another embodiment of an attack tool.

FIG. 5 is an exploded perspective diagram of another embodiment of an attack tool 100. The attack tool 100 comprises a wear-resistant base 200 suitable for attachment to a driving mechanism and a hard tip 201 attached to an interfacial surface 202 of the base 200. The attack tool 100 also comprises cemented metal carbide segments 203, 300 brazed together with a first braze 500 disposed in an interface 304 opposite the wear resistant base 200, a shank 501, and a second braze 502 disposed in an interfacial surface 202 between the base 200 and the second cemented carbide segment 300.

Further, the second cemented metal carbide segment 300 may comprise an upper end 503 that may be substantially equal to or slightly smaller than the lower end of the first cemented metal carbide segment 203.

Figure 6:
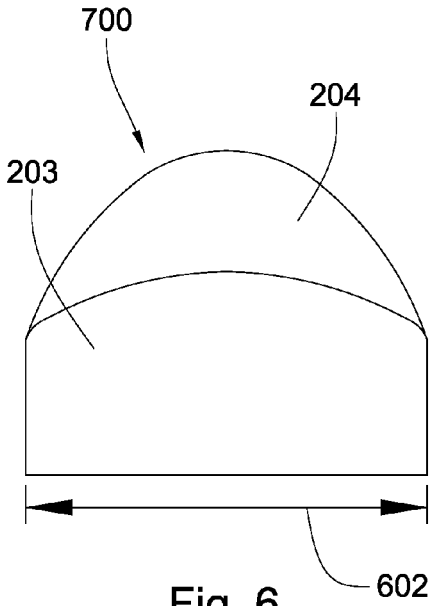
FIG. 6 is a cross-sectional diagram of an embodiment of a first cemented metal carbide segment and a superhard material.
Figure 7:
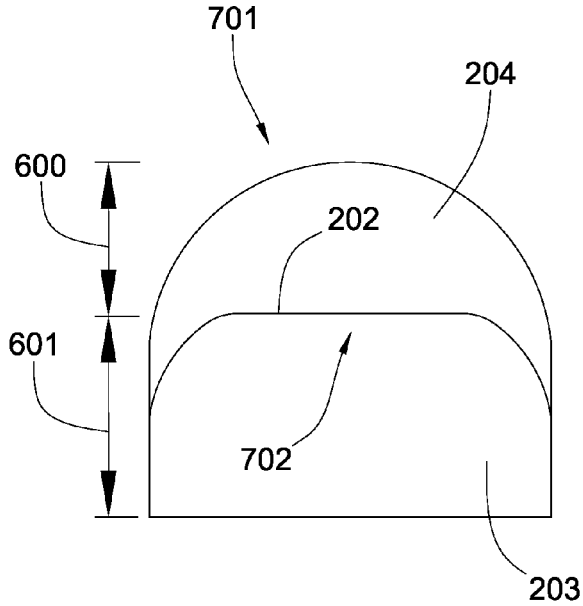
FIG. 7 is a cross-sectional diagram of another embodiment of a first cemented metal carbide segment and a superhard material.
Figure 8:
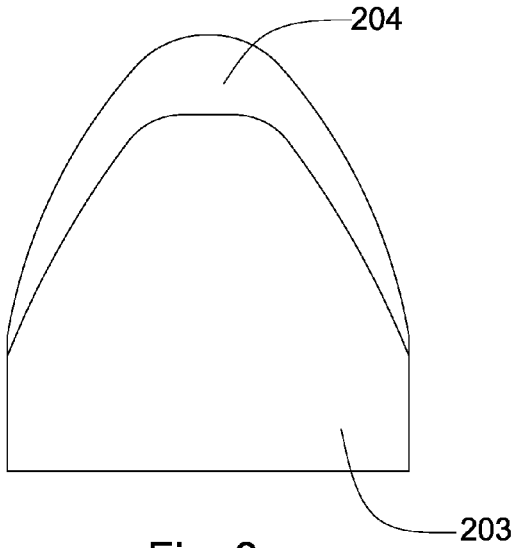
FIG. 8 is a cross-sectional diagram of another embodiment of a first cemented metal carbide segment and a superhard material.

FIGS. 6-8 are cross-sectional diagrams of several embodiments of a first cemented metal carbide segment 203 and a superhard material 204 wherein the superhard material 204 comprises a thickest portion 600 approximately equal to a thickest portion 601 of the first cemented metal carbide segment 203. The thickest portion 600 of the superhard material 204 may comprise a distance of 0.100 to 0.500 inch. It is believed that the greater the distance is from the tip of the superhard material to the interfacial surface 202, the less impact a formation will have on the first cemented metal carbide segment 203. Thus, the superhard material 204 may self buttressed and not rely on the first cemented metal carbide segment 203 for support. The cemented metal carbide 203 may also comprise a diameter 602 of 9 to 18 mm. The interface 205 between the first cemented metal carbide segment 203 and the superhard material 204 may be non-planar. The superhard material 204 may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material 204 may comprise layers of varying concentrations of cobalt or of another catalyst such that a lower portion of the superhard material has a higher concentration of catalyst than a curved working surface of the superhard material. The superhard material 204 may be at least 4,000 HK and in some embodiments it may be 1 to 20000 microns thick. The superhard material 204 may comprise a region 603 (preferably near the curved working surface 206) that is free of binder material. The average grain size of the superhard material 204 may be 10 to 100 microns in size.

Figure 8A:
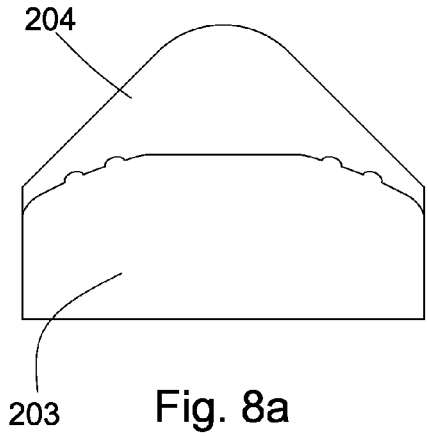
FIG. 8*a* is a cross-sectional diagram of another embodiment of a first cemented metal carbide segment and a superhard material.
Figure 9:
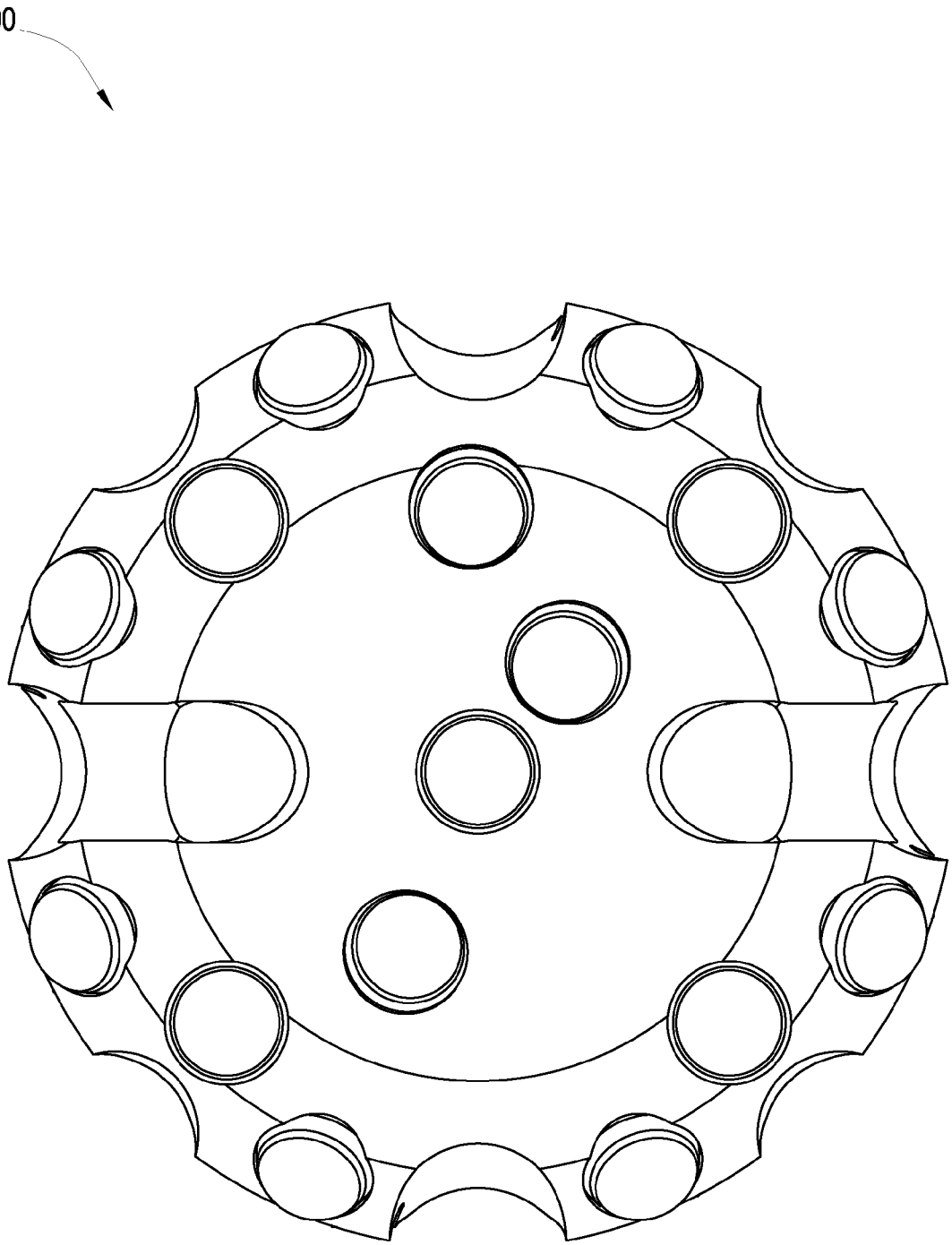
FIG. 9 is a perspective diagram of an embodiment of an insert incorporated in a percussion drill bit.
Figure 10:
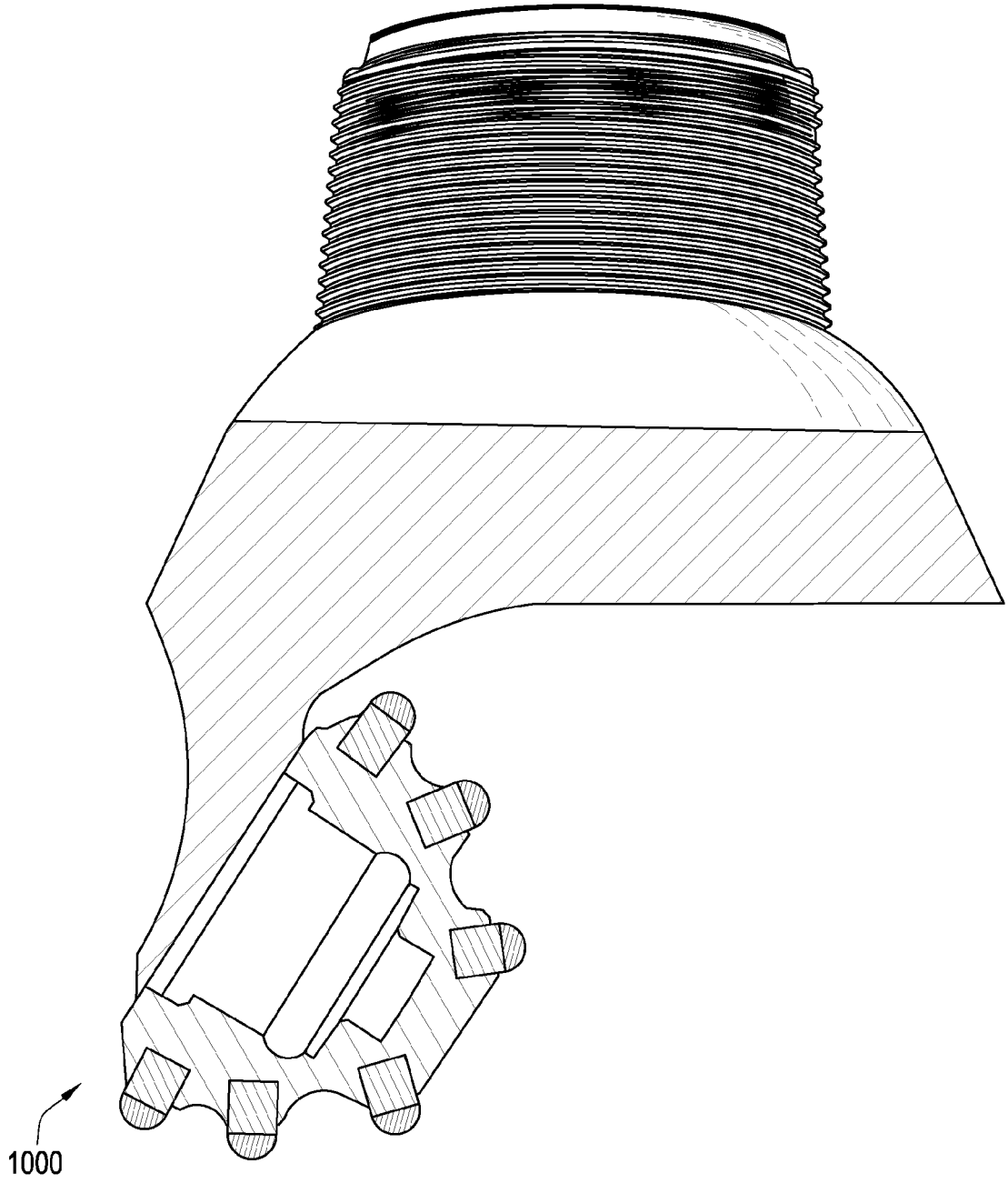
FIG. 10 is a perspective diagram of an embodiment of a roller cone drill bit assembly.
Figure 11:
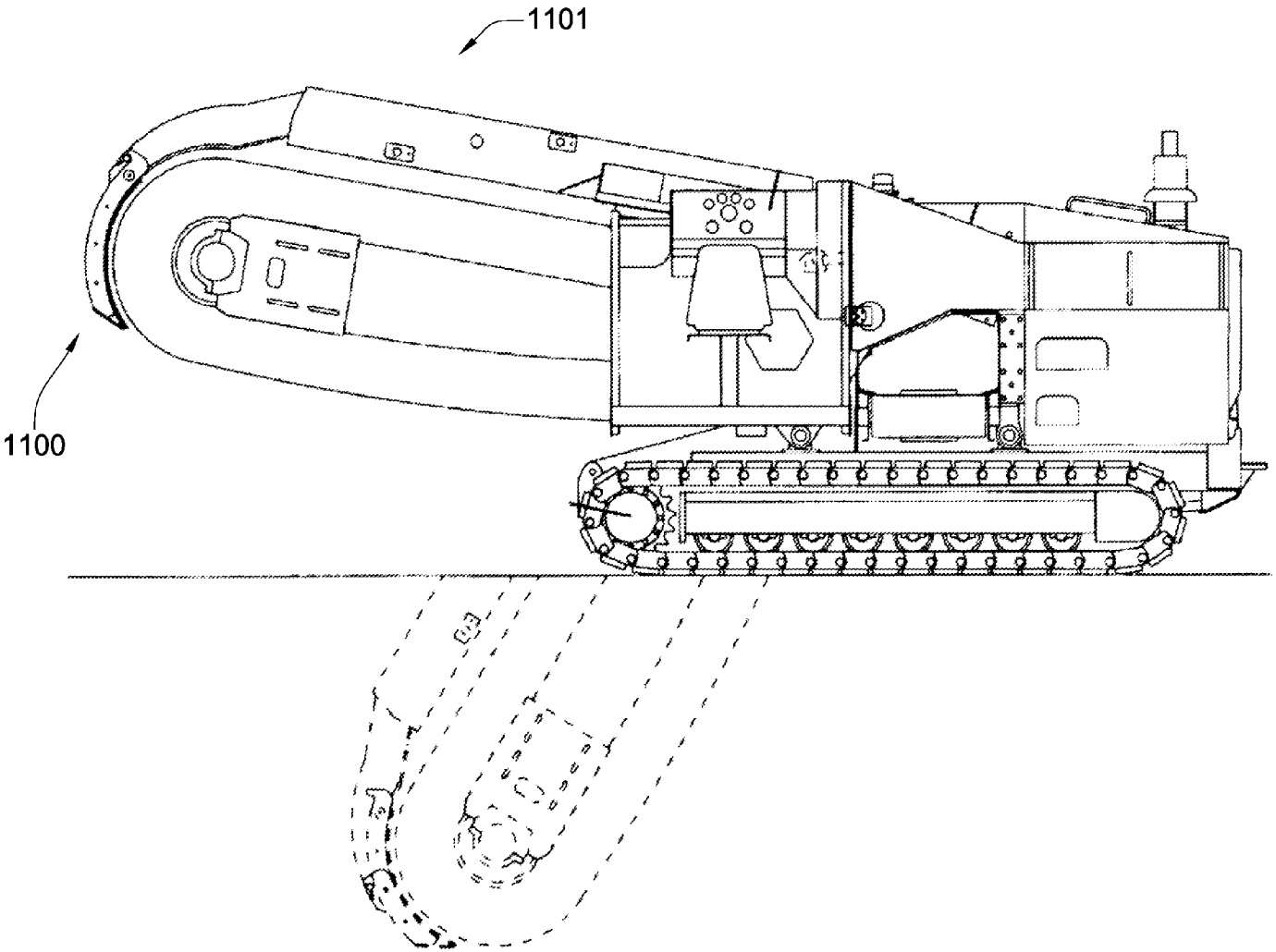
FIG. 11 is a perspective diagram of an embodiment of an excavator including a trenching attachment.
Figure 12:
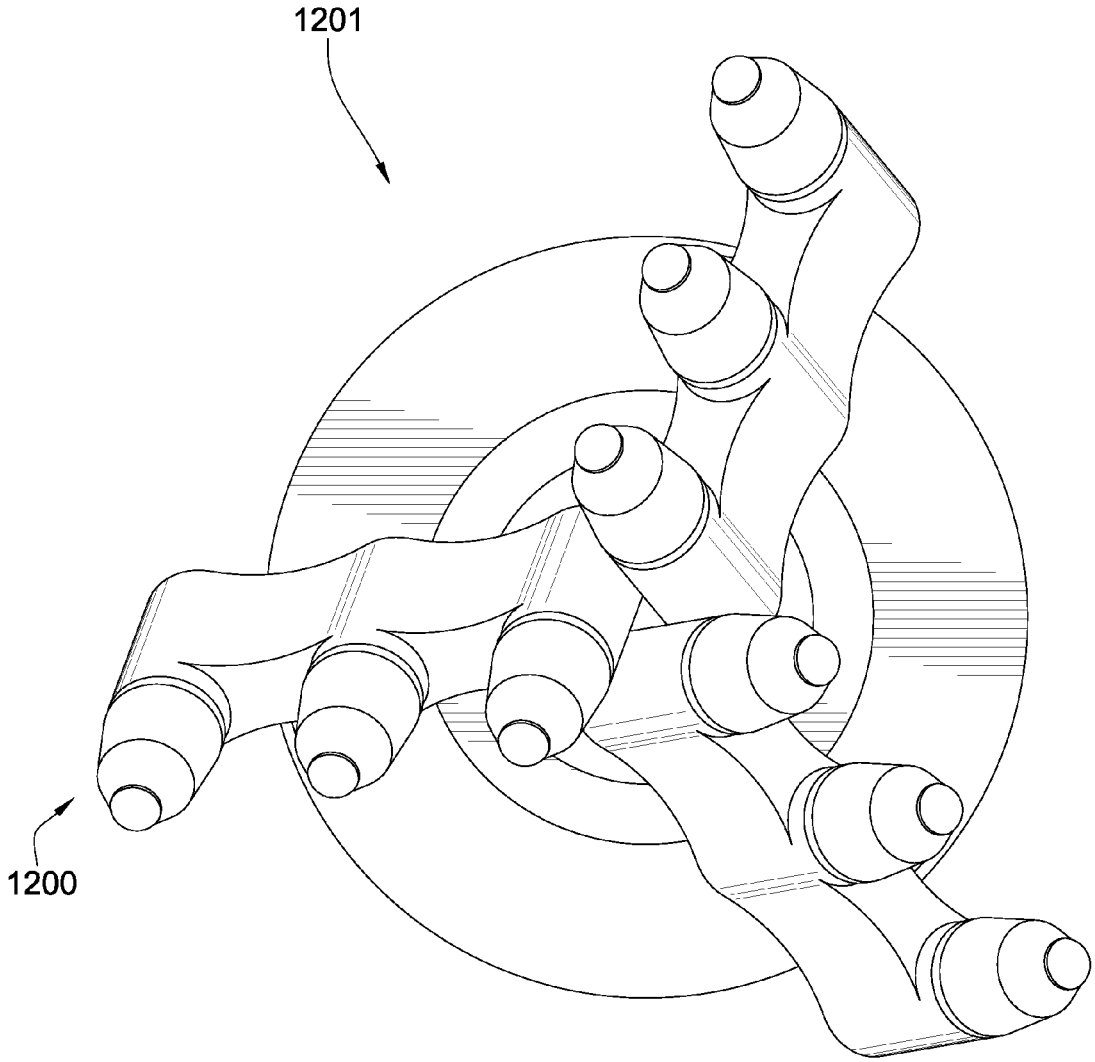
FIG. 12 is a perspective diagram of an embodiment of an insert incorporated in a mining drill bit.
Figure 13:
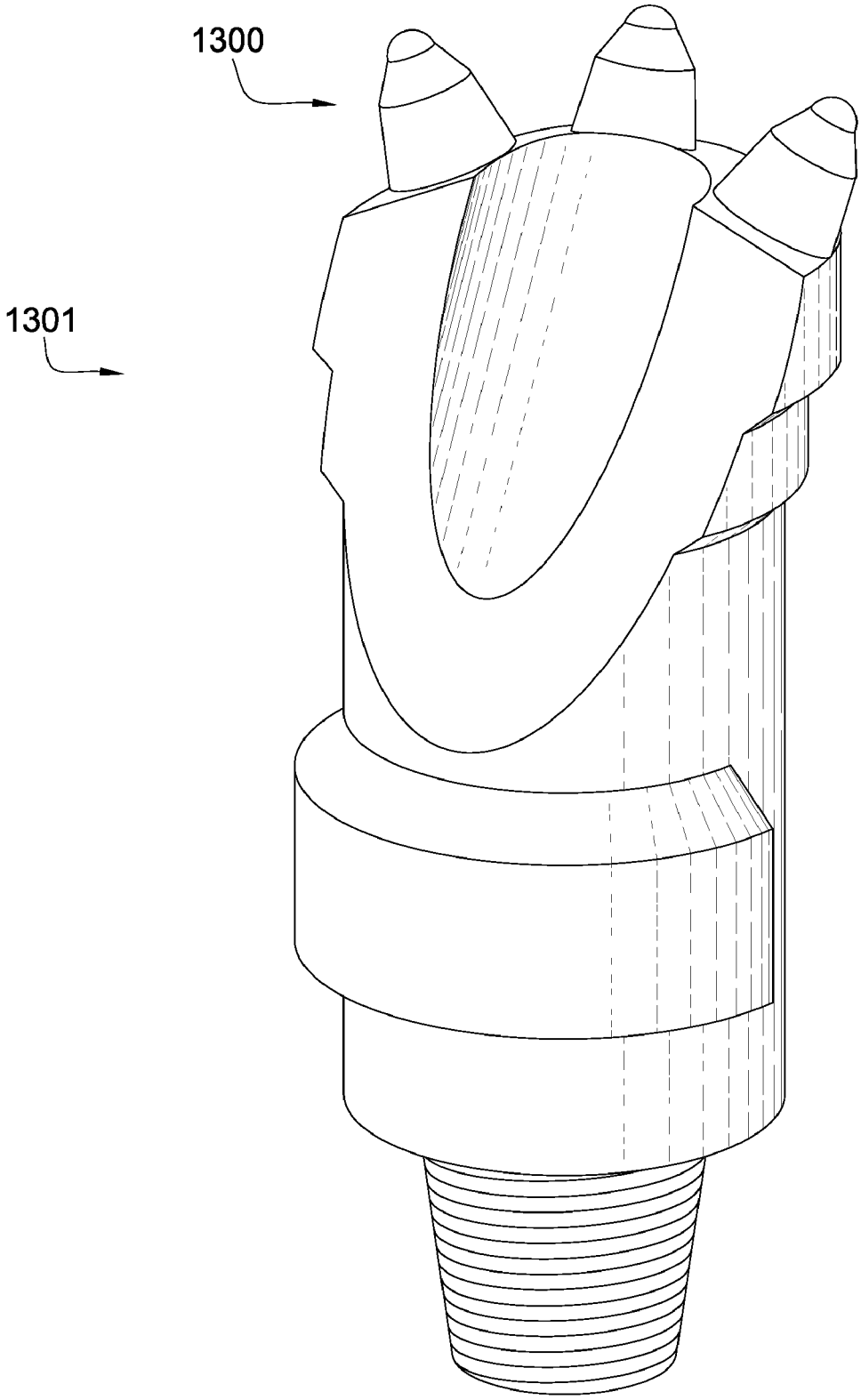
FIG. 13 is a perspective diagram of another embodiment of an insert incorporated in a drill bit.

The first cemented metal carbide segment 203 and the superhard material 204 may comprise many geometries. The superhard material 204 in FIG. 6 comprises a domed geometry 700. FIG. 7 depicts the superhard material 204 comprising a generally conical geometry 701. The generally conical geometry 701 may comprise a generally thicker portion 600 directly over a flat portion 702 of the interfacial surface 202. In FIGS. 6 and 7 the superhard material 204 comprises a blunt geometry such that its radius of curvature is relatively large compared to a radius of curvature of superhard material with a sharper geometry. Blunt geometries may help to distribute impact stresses during formation degradation, but cutting efficiency may be reduced. The superhard material 204 in FIG. 8 comprises a conical geometry. The non-planar interface between the superhard material 204 and the first cemented metal carbide segment 203 may also comprise a flat portion. Sharper geometries, such as shown in FIG. 8 and FIG. 8*a*, may increase cutting efficiency. FIG. 8*a* comprises a 0.094 radius.

FIGS. 9-13 show the current invention depicting the insert with various embodiments as an insert 900 in a percussion drill bit 901, an insert 1000 in a roller bit 1001, an insert 1100 in an excavator 1101, an insert 1200 in a mining drill bit 1201, and an insert 1300 in a threaded rock bit 1301.

Whereas the present invention has been described in particular relation to the drawings attached hereto, it should be understood that other and further modifications apart from those shown or suggested herein, may be made within the scope and spirit of the present invention.

The invention claimed is:

1. A tool, comprising:

a wear-resistant base suitable for attachment to a driving mechanism and a hard tip attached to a second carbide segment which is attached to an interfacial surface of the base;

the tip comprising a first cemented metal carbide segment bonded to a superhard material at a non-planar interface;

the tip comprising a height of 4 to 10 mm and a curved working surface opposite the interfacial surface;

wherein a volume of the superhard material is about 75% to 150% of a volume of the first cemented metal carbide segment; and wherein the first end of the second segment comprises a cross sectional thickness of about 6 to 20 mm and the second end of the second segment comprises a cross sectional thickness of 25 to 40 mm.

2. The tool of claim 1, wherein the first cemented metal carbide segment comprises a diameter of 9 to 18 mm.

3. The tool of claim 1, wherein the superhard material is selected from the group consisting of polycrystalline diamond, vapor-deposited diamond, natural diamond, cubic boron nitride, infiltrated diamond, layered diamond, diamond impregnated carbide, diamond impregnated matrix, silicon bonded diamond, and combinations thereof.

4. The tool of claim 1, wherein the superhard material may be sintered with a catalytic element selected from the group consisting of iron, cobalt, nickel, silicon, hydroxide, hydride, hydrate, phosphorus-oxide, phosphoric acid, carbonate, lanthanide, actinide, phosphate hydrate, hydrogen phosphate, phosphorus carbonate, alkali metals, alkali earth metals, ruthenium, rhodium, palladium, chromium, manganese, tantalum and combinations thereof.

5. The tool of claim 1, wherein the first cemented metal carbide segment comprises a height of 2 to 6 mm.

6. The tool of claim 1, wherein the first cemented metal carbide segment comprises a region proximate the non-planar interface comprising a higher concentration of a binder than a distal region of the first cemented metal carbide segment.

7. The tool of claim 1, wherein a volume of the tip is 0.2 to 2.0 ml.

8. The tool of claim 1, wherein the curved working surface is conical, semispherical, domed or combinations thereof.

9. The tool of claim 1, wherein the superhard material comprises a thickest portion approximately equal to a thickest portion of the first cemented metal carbide segment.

10. The tool of claim 1, wherein the driving mechanism is attached to a milling drum, a trenching machine, a mining machine or combinations thereof.

11. The tool of claim 1, wherein the driving mechanism is attached to a drill pipe.

12. The tool of claim 1, wherein the second carbide segment and the tip are brazed together with a first braze comprising a melting temperature from 700 to 1200 degrees Celsius.

13. The tool of claim 12, wherein the melting temperature is from 800 to 970 degrees Celsius.

14. The tool of claim 13, wherein the first braze comprises a material selected from the group consisting of silver, gold, copper, nickel, palladium, boron, chromium, silicon, germanium, aluminum, iron, cobalt, manganese, titanium, tin, gallium, vanadium, indium, phosphorus, molybdenum, platinum, zinc, and combinations thereof.

15. The tool of claim 1, wherein the first and second metal carbide segments comprise a metal selected from the group consisting of tungsten, titanium, molybdenum, niobium, cobalt, and/or combinations thereof.

16. The tool of claim 1, wherein a portion of the superhard material is 0.50 to 3 mm away from an interface between the first and second carbide segments.

17. The tool of claim 1, wherein the second cemented metal carbide comprises a volume of 0.1 to 10 ml.

18. The tool of claim 1, wherein the second cemented metal carbide comprises a generally frustoconical geometry.

19. The tool of claim 1, wherein the first and second metal carbide segments are generally coaxial.

* * * * *